United States Patent [19]

Senn

[11] 3,970,312

[45] July 20, 1976

[54] EDUCATIONAL GAME

[76] Inventor: Herall G. Senn, 3815 War Memorial Drive 59B, Peoria, Ill. 61614

[22] Filed: July 14, 1975

[21] Appl. No.: 595,348

[52] U.S. Cl. ..... 273/130 A; 35/31 D; 35/35 H; 273/130 D; 273/136 C

[51] Int. Cl.[2] ..... A63F 9/18

[58] Field of Search ..... 35/31 C, 31 D, 31 F, 35/35 H; 273/130 R, 130 A, 130 D, 130 E, 136 B, 136 C, 136 E, 136 K, 157 R; 40/10 D, 64 R

[56] References Cited

UNITED STATES PATENTS

| | | | |
|---|---|---|---|
| 1,273,381 | 7/1918 | Lacasse | 273/136 C |
| 1,884,971 | 10/1932 | Galbraith | 40/64 R |
| 1,942,291 | 1/1934 | Jefferson | 273/130 D |
| 1,988,301 | 1/1935 | Coffin | 273/136 C |
| 2,100,421 | 11/1937 | Wupper | 273/136 C |
| 3,593,434 | 7/1971 | McGarry | 273/157 R |
| 3,820,262 | 6/1974 | Dewsnap | 40/10 D |
| 3,847,397 | 11/1974 | Price | 273/136 C |

*Primary Examiner*—Anton O. Oechsle
*Assistant Examiner*—Harry G. Strappello
*Attorney, Agent, or Firm*—Bacon & Thomas

[57] ABSTRACT

An upright game board is formed of two face-to-face transparent panels having two groups of aligned openings. A card is removeably positioned between the panels and has corresponding groups of openings aligned with those of the panels. Indicia on both sides of the card associated with each opening with the indicia of the first group constitute, for example, questions with the indicia for the second group constituting answers to those questions. One player places a peg in the hole denoting a selected question, from one side of the board, and another player places a peg in the hole of the answer group he selects as the correct answer to the selected question from the other side of the board. A plurality of interchangeable cards are provided and the pegs are each provided with further indicia for use in scoring. The game board is formed to include a supporting base constituting containers for the pegs.

5 Claims, 8 Drawing Figures

EDUCATIONAL GAME

BACKGROUND OF THE INVENTION

This invention is in the field of board games and particularly competitive and educational games for two or more players.

Educational board games, as such, are known but are generally limited as to scope of subject matter or are of complicated and/or of bulky construction. Such prior games do not usually provide competitive aspects in which a definite scoring system may be incorporated.

SUMMARY OF THE INVENTION

It is a principal object of this invention to provide an educational board game of unlimited scope as to subject matter or complexity thereof.

Another object is to provide an educational board game adapted to be played under simple and limited rules and by simple manipulations whereby it may be played by players of a wide range of ages.

A further object is to provide an educational board game that is of simple construction and economical to manufacture.

A still further object is to provide such a game having not only educational features but also involving competition between players.

An additional object is to provide a board game capable of use under different rules of play without modification of the apparatus.

Other objects and advantages will become apparent to those skilled in the art as the description proceeds with reference to the accompanying drawings.

DESCRIPTION OF A PREFERRED EMBODIMENT

Figure 1:
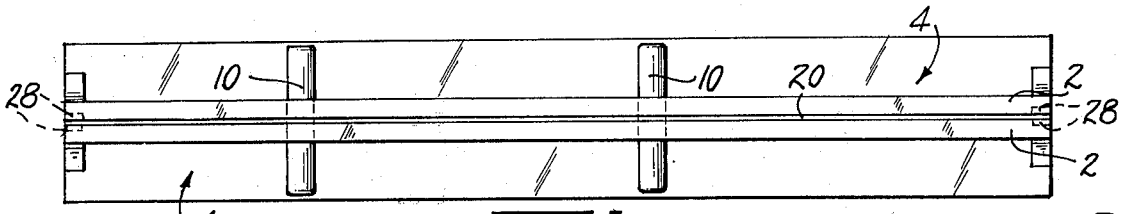
FIG. 1 is a top plan view of a game board embodying the present invention and showing a pair of movable pegs therein.
Figure 2:
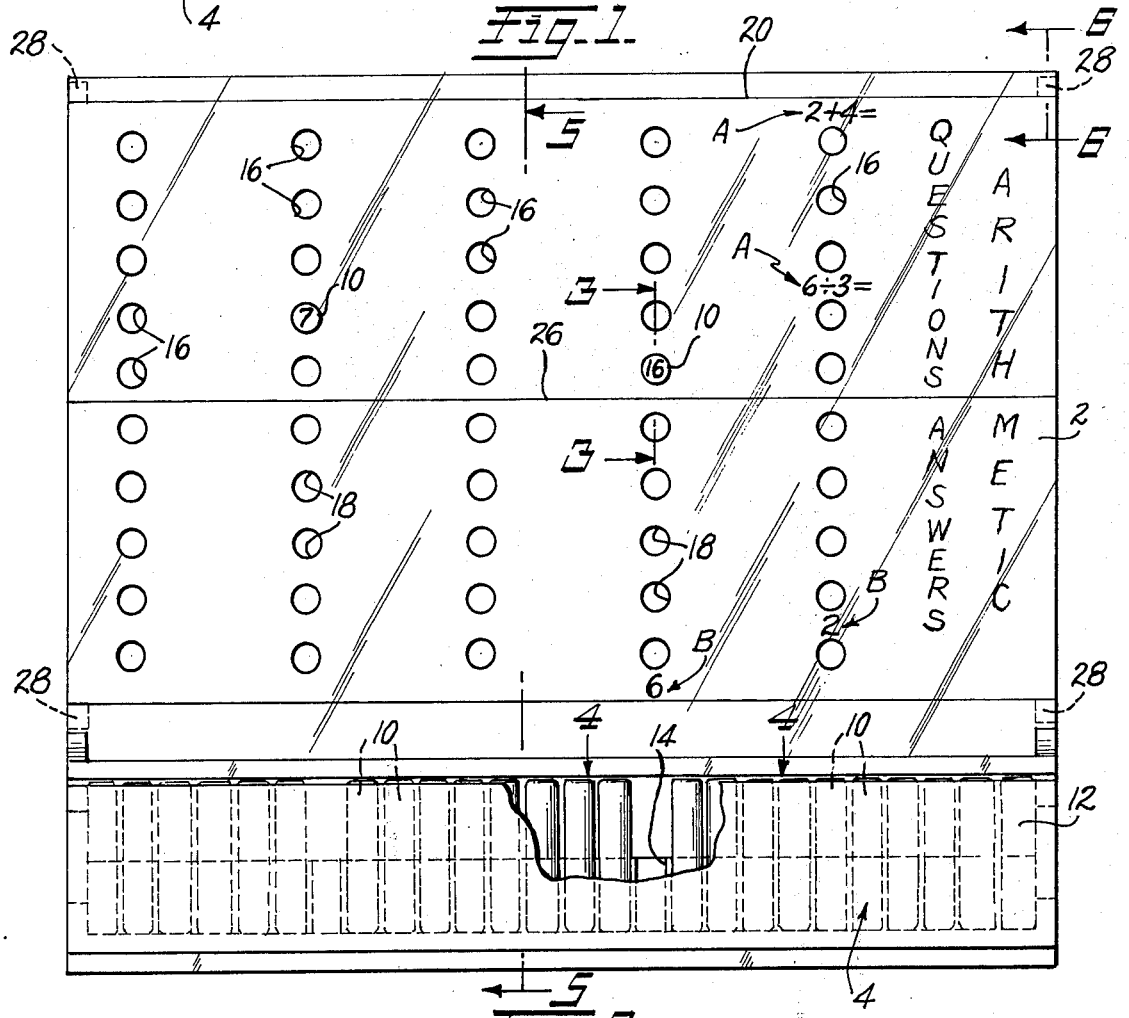
FIG. 2 is a front elevational view of the board of FIG. 1 with parts broken away.
Figure 3:
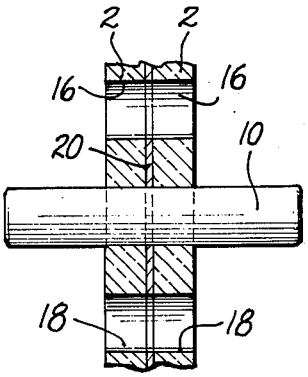
FIG. 3 is an enlarged fragmentary sectional view taken on the line 3—3 of FIG. 2.
Figure 4:
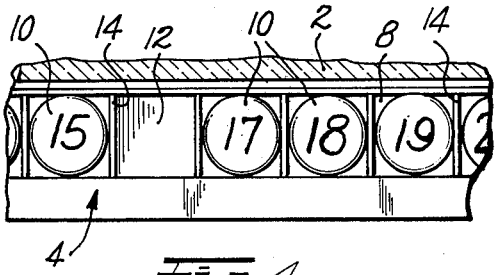
FIG. 4 is an enlarged fragmentary sectional view taken on line 4—4 of FIG. 2.
Figure 5:
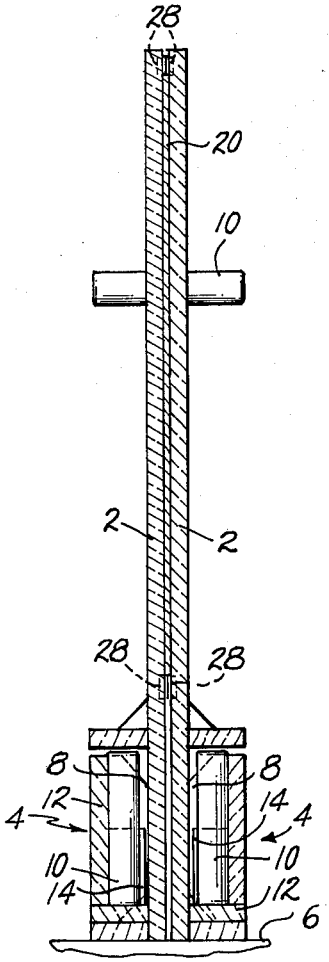
FIG. 5 is a vertical sectional view taken on line 5—5 of FIG. 2.
Figure 6:
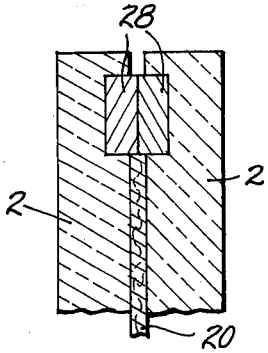
FIG. 6 is an enlarged sectional view taken on the line 6—6 of FIG. 2.

FIGS. 1, 2 and 5 show a preferred form of game board in which two separate panels 2 of transparent plastic are held in upright and face-to-face relation by suitable base structures 4 fixed to the panels and resting on a supporting surface 6, such as a table top or the like. The two panels 2 and their base structures 4 are of identical construction but separable, as will be described.

Each base structure 4 is in the form of a container or compartment defining a storage chamber 8 for a plurality of game pieces or pegs 10. Each base structure includes a generally L-shaped member 12 functioning as a removable cover for the storage chamber and base support for the pegs therein. As shown, each member 12 is provided with partition numbers 14 dividing the storage chamber into stalls for the individual pegs 10.

Figure 8:
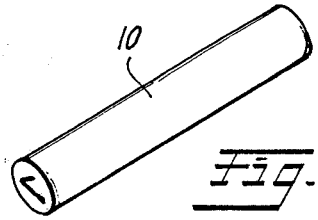
FIG. 8 is a perspective view of one of the pegs.

Each of the panels 2 is provided with a first group of openings 16 and a second group of openings 18 therethrough so arranged that when the panels are in face-to-face relation as shown in the drawings all openings in one panel are in registry with corresponding openings in the other panel. As shown there are 25 openings in each group and there are 26 pegs in each chamber 8. The pegs of each group are serially numbered, one to 25, the numbers appearing on each end of each peg. The ends of the 26 peg of each group has a check mark thereon, see FIG. 8. The pegs of each group also have group-identifying characteristics, such as being of different colors.

Figure 7:
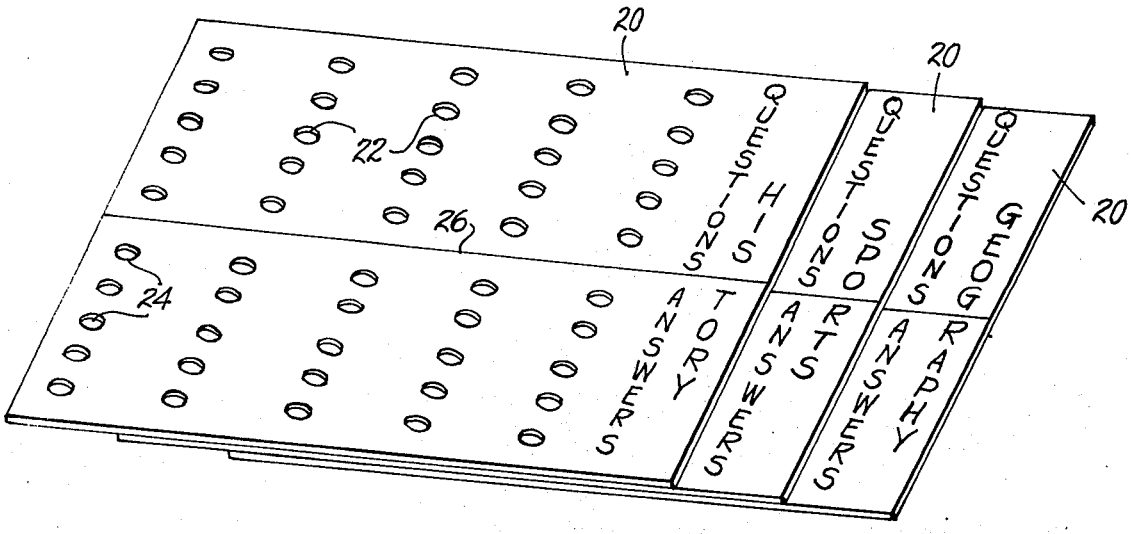
FIG. 7 is a perspective view of a representative group of cards.

The game also includes a plurality of cards 20 exemplified by the cards shown in FIG. 7. Each card 20 is preferably opaque and provided with two groups of openings 22 and 24 divided by a suitable indicia line 26. The openings 22 and 24 are the same size as and are in the same spatial arrangement as the openings 16 and 18 in panels 2 and all the openings are of a size to slidably receive the pegs 10.

Any selected card 20 may thus be placed between the panels 2 and positioned so that the openings 22 and 24 in the cards register with the openings 16 and 18 in panels 2. The parts are held in the described relation during play by magnets 28. As shown, each panel 2 has four small embedded magnets projecting slightly from its inner face and opposite similar magnets on the other panel. Thus the attraction of the magnets for each other effects a releasable clamping of the card 20 between the panels 2 and the projecting portions of the magnets assist in properly positioning the cards 20. It is to be noted that the distance between upper and lower magnets is about the same as the vertical dimensions of the cards 20.

The different cards 20 preferably, but not necessarily, relate to different subjects, as suggested in FIGS. 1 and 7.

Each of the cards 20 is provided with indicia as at A of FIG. 2, which are shown as incomplete equations, associated with each opening 22 and constituting questions relating to the subject matter of that card, and indicia (see B of FIG. 2) associated with each of the openings 24 constituting answers to those questions. Obviously, the questions adjacent the first group of holes 22 are arranged in a different sequence or order from the correct answers to those questions, adjacent the holes 24 of the second group. Corresponding indicia appears on both sides of the cards 22, adjacent the same opening.

While the foregoing description refers to questions and answers it is to be understood that instead of questions and answers, specifically, the indicia may comprise mathematical equations and their results, first and second parts of quotations, mottoes, book or song titles, or literary or musical works and their authors or composers. The indicia associated with the openings will be referred to hereafter as questions and answers or as incomplete statements of fact and it is to be understood that such reference may include any of the above or other word, symbol or design arrangements not enumerated herein.

The game will also include an "answer key" (not shown) containing the correct answers for each of the questions.

Rules of Play

The players select a game card from the many available on various subjects. The card is mounted sandwich-style between the two panels of the playing board, and the board is stood upright between the two players or sides.

The players decide which side will ask the first question by any means they choose. Side I selects a question-answer combination believed to be correct and inserts their peg No. 1 in the selected question hole. Side II responds by inserting their peg No. 1 in the answer hole that they select as being correct. If side I accepts the answer, both pegs remain in the board. Side II then asks the next question by inserting their peg No. 2 in a question hole. But, if side I does not agree with the answer, it challenges by moving the answer peg to the hole that they believe to be correct. The answer key is then referred to as the authority. If side I is correct in its challenge it wins the highest numbered unplayed peg from side II, and both No. 1 pegs remain in the holes. If side II was correct in its original answer, the answer peg is returned to the correct hole and side II wins the highest numbered unplayed peg from side I. If the answer key reveals that neither side was correct, the answer peg is moved to the correct hole and neither side wins a peg. In any case the two sides take alternate turns asking questions. Play continues in this manner.

As the game progresses, and it is a side's turn to ask a question, that side may challenge any answer that has been previously accepted, regardless of who asked or answered the question originally. This is possible since the questions and answers are matched by the corresponding numbers on the pegs.

When either side has none of its original pegs remaining with which to answer a question, the game is over. The side with the highest number of the opponent's pegs is the winner.

Pressure Play Variation

This variation places the burden of time on the players, which has not been a consideration under the above rules. With pressure play the game starts with both sides placing a question peg at the same time. One side starts with its No. 1 peg and the other side starts with its No. 25 peg. The No. 1 peg has the right-of-way in case both sides selected the same question. This has been predetermined by any method the players choose. As soon as one side has answered the opponent's question, that side may then immediately ask another question even though the opponent has not yet answered the question presented to it and providing the opponent has not challenged. In no case can a player ask a question if it has a question to answer. A challenge stops all action until it is settled. When a side has asked two questions which the opponent has not answered, that side may then answer the first of the two questions itself by placing the "check" (/) peg in the appropriate answer hole and immediately calling for a "check" which stops play. The answer key is checked and if the side calling for the check is found to be correct it wins the opponent's peg that should have been used to answer the question. The successful side's check peg is removed from the correct answer hole and the hole remains empty. If the side calling for the check is found to be incorrect, the opponent places its appropriately numbered peg in the correct answer hole and wins the other side's No. 13 peg or — in case the No. 13 peg has already been lost — any peg the other side chooses. Play resumes.

Because of the fast pace and increased concentration required by pressure play rules, it is especially appropriate for team play (two players on each side). For example, one player can concentrate on answering the opponent's questions while his partner asks questions. Or a team can use any other method it chooses.

While a single specific embodiment has been shown and described herein, and specific rules of play have been set forth, the same are merely illustrative of the principal features of the invention. Other embodiments and rules which fall within the scope of the appended claims may be employed.

I claim:

1. An educational game apparatus comprising:

an upstanding game board and base means for holding the same in an upright position, said game board being defined by a pair of separable transparent panels, said panels being arranged in substantially face-to-face relation;

an opaque card removably positioned between said panels;

first and second groups of registering openings through said panels and card;

identical indicia means on each side of said card for each opening of said first group, each indicia constituting an incomplete statement of fact, the indicia at each opening being different from the indicia at any other opening;

identical indicia means on each side of said card for each opening of said second group, each constituting a completion of the incomplete statement of the indicia associated with one of the openings of said first group, the indicia at each opening being different from the indicia at any other opening;

the indicia of said first group being arranged in predetermined order and the corresponding indicia of the second group being arranged in a different order; and a plurality of pegs adapted to be selectively inserted through any of said aligned holes from either side of said game board.

2. A game as defined in claim 1 wherein there are two groups of said pegs, the pegs of each group all having identical identifying characteristics different from the identifying characteristics of the other group.

3. A game as defined in claim 2 wherein the ends of said pegs of each group bear sequential numerical indicia.

4. A game as defined in claim 2 wherein the number of pegs in each group is at least equal to the number of openings in each group of openings.

5. A game as defined in claim 1 wherein the indicia associated with the holes of said first group are questions and wherein the indicia associated with the holes of the second group are answers to these questions.

* * * * *